US005791554A

United States Patent [19]

Jensen

[11] Patent Number: 5,791,554

[45] Date of Patent: Aug. 11, 1998

[54] GABLE LID CLAMSHELL CONTAINER

[75] Inventor: Kurt D. Jensen, Lebanon, Ohio

[73] Assignee: International Paper, Purchase, N.Y.

[21] Appl. No.: 883,424

[22] Filed: Jun. 26, 1997

[51] Int. Cl.[6] ..... B65D 5/00

[52] U.S. Cl. ..... 229/148; 229/116; 229/108

[58] Field of Search ..... 229/146, 160, 229/126, 148, 108, 116, 115; D9/430, 431, 433

[56] References Cited

U.S. PATENT DOCUMENTS

| | | | |
|---|---|---|---|
| D. 261,613 | 11/1981 | Forbes . | |
| D. 282,720 | 2/1986 | Borg . | |
| D. 317,262 | 6/1991 | Bluff . | |
| D. 359,904 | 7/1995 | Mabry . | |
| D. 373,528 | 9/1996 | Wei | D9/431 |
| 1,791,956 | 2/1931 | Cowles . | |
| 2,084,308 | 6/1937 | Behr . | |
| 2,151,066 | 3/1939 | Anderson . | |
| 2,788,169 | 4/1957 | Leval . | |
| 3,134,708 | 5/1964 | Lohnes . | |
| 3,463,379 | 8/1969 | Dlugopolski | 229/146 X |
| 3,485,202 | 12/1969 | Platt, III | 229/116 X |
| 3,563,374 | 2/1971 | Lund . | |
| 4,418,497 | 12/1983 | Mastriano . | |
| 4,516,718 | 5/1985 | Forbes, Jr. | 229/146 |
| 4,986,464 | 1/1991 | Leigh | 229/116 |
| 5,037,026 | 8/1991 | Hanko | 229/148 X |
| 5,427,308 | 6/1995 | Swift . | |
| 5,431,333 | 7/1995 | Lorenz . | |

*Primary Examiner*—Allan N. Shoap
*Assistant Examiner*—Tri M. Mai
*Attorney, Agent, or Firm*—Christopher Nicastri

[57] ABSTRACT

A clamshell type paperboard container formed from a unitary blank of paperboard. Two embodiments are described. In the first, the container is square and the lid includes four triangular panels meeting at an elevated and central common point. In the second, the container in rectangular and the lid includes two triangular panels and two trapezoidal panels, and the central elevated portion of the lid includes an elongated ridge or rib. These constructions prevent stacking and hence inadvertent crushing of a closed and filled container. The slanting sides of the lids yield an easel effect for graphics thereon.

7 Claims, 5 Drawing Sheets

GABLE LID CLAMSHELL CONTAINER

BACKGROUND OF THE INVENTION

This invention relates to a container and more particularly to a container fashioned from a unitary blank of paperboard or other stiff, foldable, and resilient sheet material and having a lower tray and an upper lid, the lid and tray being foldably or hingedly secured together so that the lid may be folded down onto and as well as away from the tray. Any conventional latching configuration may be employed for releasably latching the lid down onto the tray. Such containers exhibit utility in the packaging of fast foods. Typically, a freshly made hamburger or other sandwich is placed in the tray portion of a conventional clamshell container and the lid folded or hinged downwardly and releasably latched, to thereby form a food package.

SUMMARY OF THE INVENTION

According to the practice of this invention, a clamshell type container is formed, in one embodiment, so as to include a gable type lid generally defined by four triangular panel sections, with the central portion of the lid being the highest and forming a tip. According to a second embodiment of the invention, the same general form of container is utilized, except that instead of being square, the clamshell container is rectangular. The lid includes a central ridge, with the lid narrower ends defined by two respective generally triangular panel sections, and the lid widest portions including two generally trapezoidal panel sections. In each of the two embodiments, the lid includes a double thickness of the paperboard from which the container is fashioned.

DETAILED DESCRIPTION OF THE INVENTION

Figure 1:
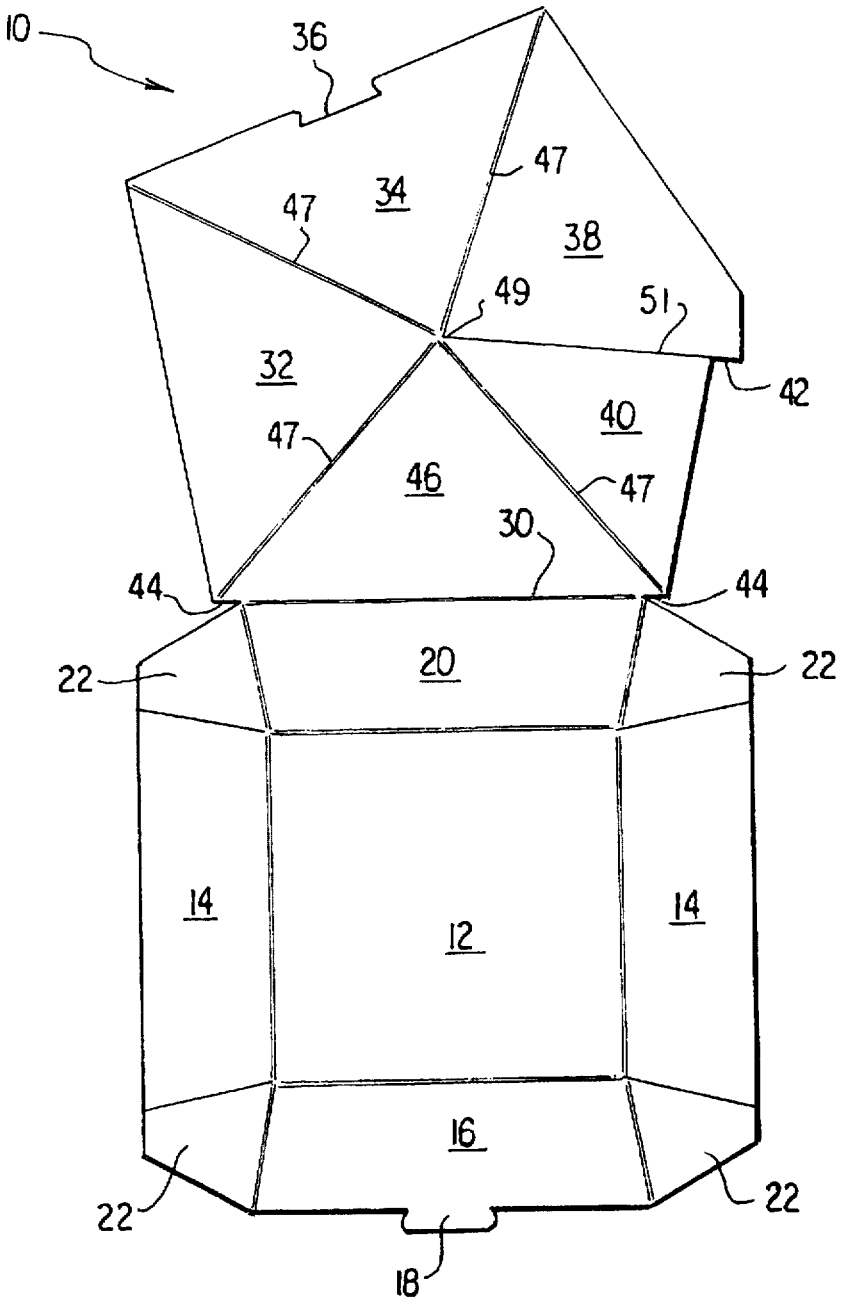
FIG. 1 is a plan view of a unitary blank of paperboard from which the container of this invention is fashioned, according to a first embodiment.

Referring now to FIG. 1 of the drawings, the numeral 10 denotes generally a unitary blank of paperboard from which a gable lid container of this invention is formed, according to a first embodiment. The tray of the container is fashioned from the lower half of the blank, while the lid is fashioned from the upper half. The tray includes a central bottom panel 12 having two side walls 14, a front wall 16 and a rear wall 20, the walls being foldably joined to the bottom panel. Front and rear walls 16 and 20 are provided at their respective ends with glue tabs 22 foldably connected thereto. Front wall 16 has a projecting tongue 18 which forms a part of a releasable latch, later to be described. A common fold line 30 connects the upper edge of rear wall 20 to the lower portion of the lid. The lid includes generally triangular panels or sections 32, 34, 38, 40, and 46, with the latter being integrally secured to rear wall 20 of the tray through common fold line 30. Fold lines 47 join the generally triangular roof panels to each other, with one roof panel 34 having an indentation or recess 36 which cooperates with tongue 18 to form a releasable latch. Fold lines 47 meet at a common point 49, with cut line 51 extending from point 49 radially outwardly to the periphery of the lid. Segment 42 is located along cut line 51, with the free edge of triangular lid panel 40 meeting cut line 51 at one end of segment 42. Two lower portions of triangular panel 46 extend slightly beyond the ends of common fold line 30, to define regions 44.

Figure 2:
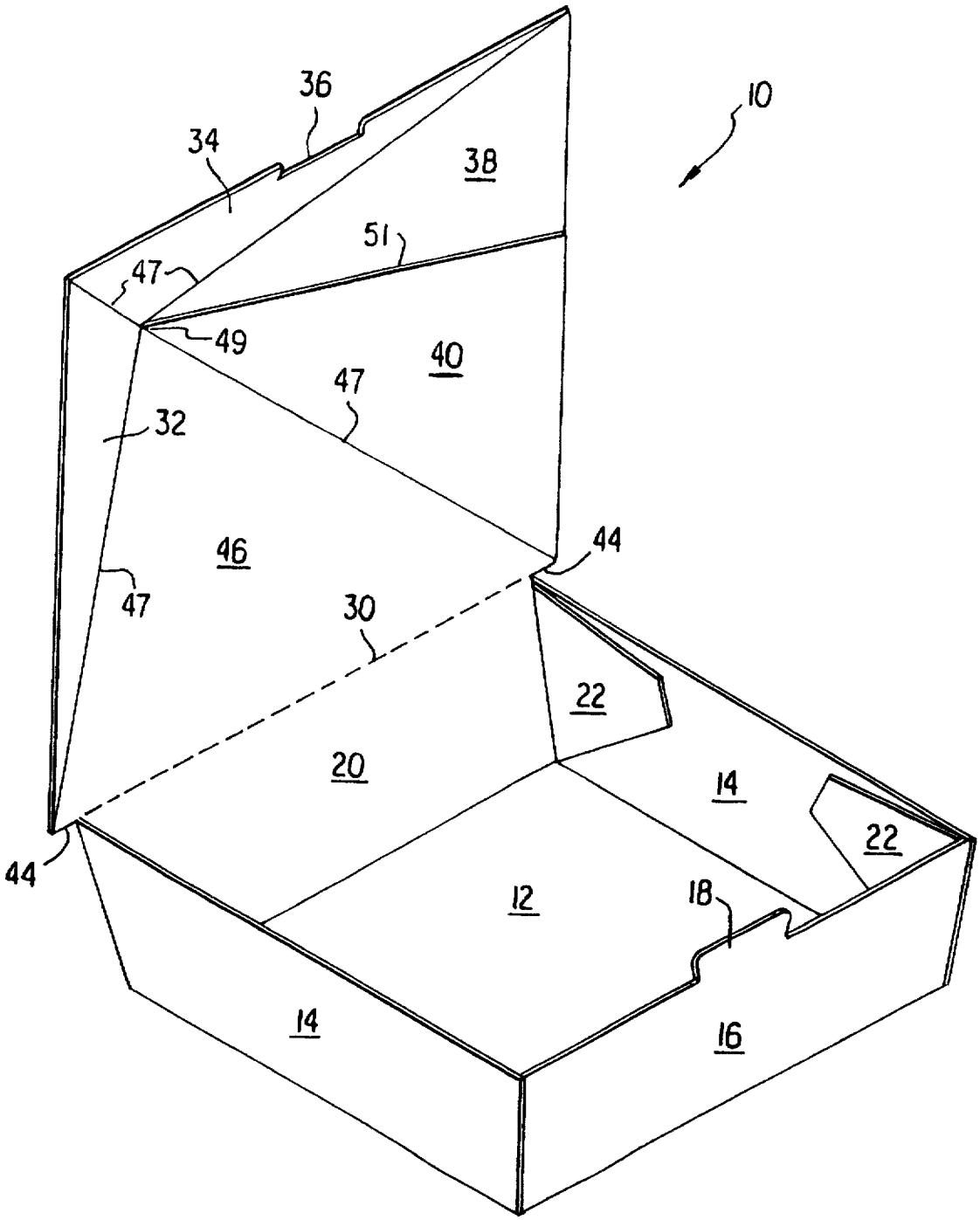
FIG. 2 is a perspective view showing the blank of FIG. 1 as glued and erected, and showing the lid of the clamshell container in an open position.
Figure 3:
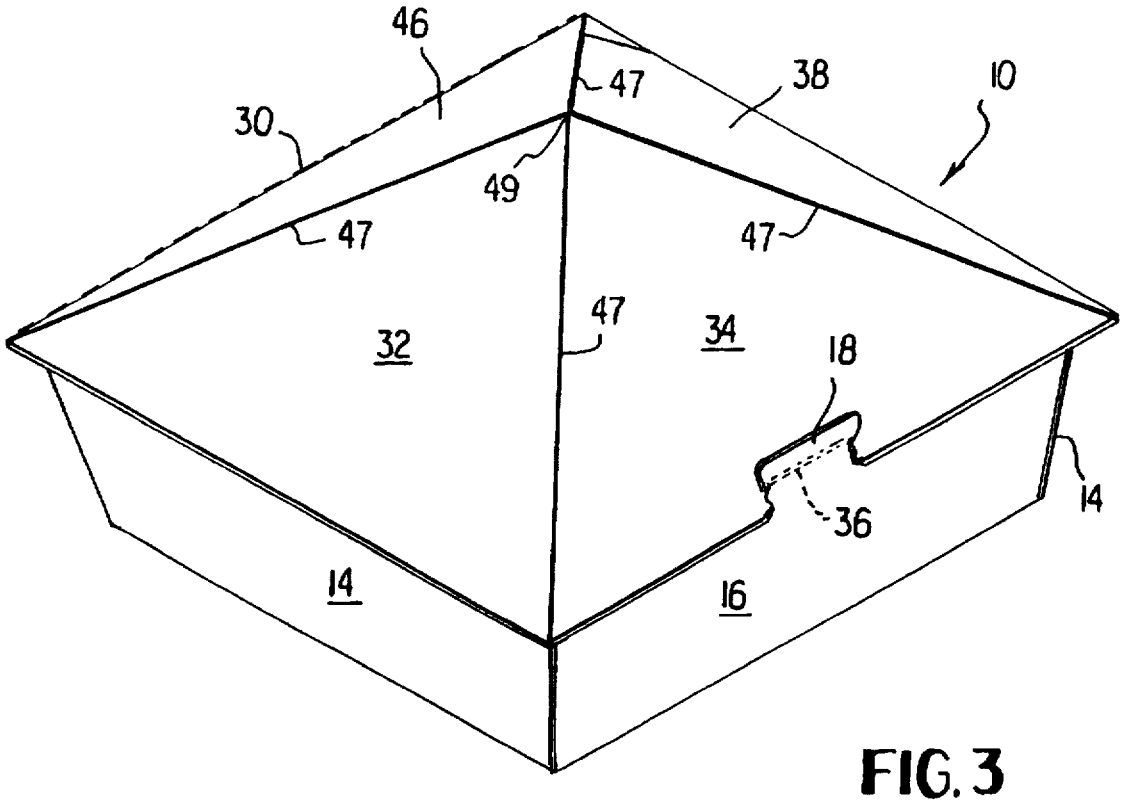
FIG. 3 is a perspective view of the container of FIG. 2 with the lid closed.

Referring now to FIGS. 2 and 3, the blank of FIG. 1 has been folded and glued, with any conventional adhesive securing glue panels 22 to their respective side walls 14. In forming the lid of the container, triangular lid panel 38 is pivoted or rotated about point 49 so as to overlie triangular roof panel 40. The lid panels bend slightly about fold lines 47 and form a dome like structure having a central tip 49. Thus, at the completion of the erection of the container, the lid exhibits four slanted triangular panels. The lid is releasably latched to the tray by means of tongue 18 and recess 36, as shown at FIG. 3 of the drawings, when the lid has been folded down from the position of FIG. 2, about common fold axis 30, to close the container. FIG. 2 also shows the end regions 44 of triangular panel 46 as extending beyond the two ends of common fold line 30 to form side overhangs. Further, the free edge of lid panel 34 overhangs front wall 16.

Figure 4:
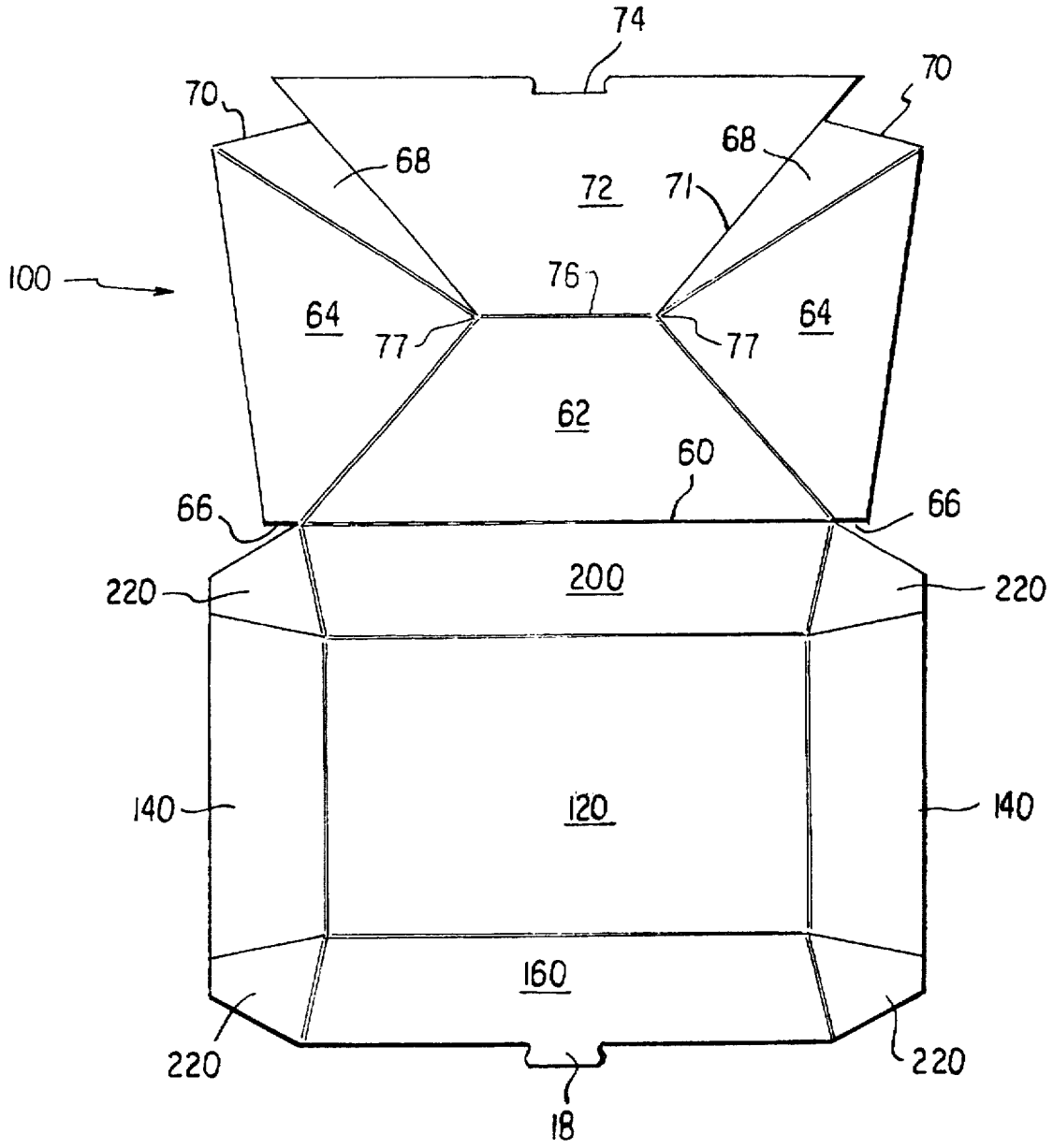
FIG. 4 is a view similar to FIG. 1 and showing a second embodiment of the invention.

Referring now to FIG. 4, 100 denotes generally a unitary paperboard blank for forming the container of this invention according to a second embodiment. The lower half of the blank forms the tray and includes a central bottom panel 120, side walls 140, a front wall 160 and a rear wall 200. Glue tabs 220 are hingedly secured to the ends of front and rear walls 160 and 200. The upper or lid portion of the blank is joined to the tray rear wall 200 through a common fold line 60. The lid also includes a pair of generally triangular end panels 64 and 68, the latter having free edge portions 70. A lower, generally trapezoidal panel 62 is connected along its longest parallel edge to tray rear wall 200 to define a common fold axis 60. An upper generally trapezoidal panel 72 along its longest parallel side includes a recess 74 for latching the lid to the tray. Cut lines 71, between panels 68 and 72, generally define the non-parallel sides of trapezoidal panel 72. The shortest parallel edges of the two trapezoidal panels 62 and 72 meet and define a fold line 76 whose ends are designated as 77.

Figure 5:
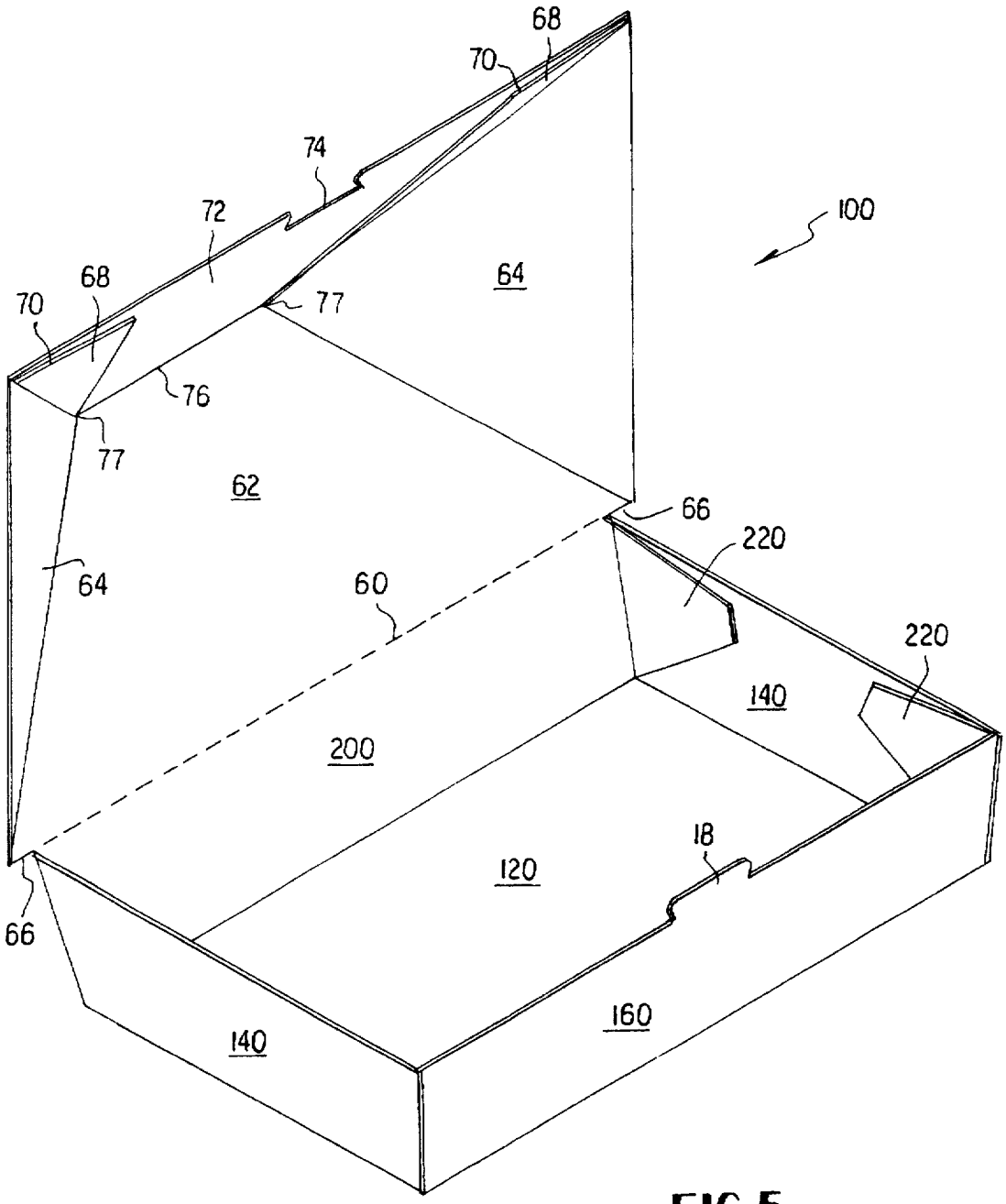
FIG. 5 is a view similar to FIG. 2, and showing the blank of FIG. 4 after it has been assembled and erected.

Referring now to FIG. 5 of the drawings, the blank of FIG. 4 has been glued and erected, with glue tabs 220 being adhered to respective side walls 140, and with triangular sections 72, so that all of respective triangular portions 68 are overlaid by portions of trapezoidal panel 72. Triangular lid panels 68 thus bend about the illustrated fold lines between panels 64 and 68 so as to underlie upper generally trapezoidal panel 72 when the lid is formed. Panels 62 and 64 also slightly bend about their illustrated fold lines to form a dome like structure for the lid. The longer parallel edge of panel 72, being a free edge, overhangs front wall 160. Glue tabs 220 and triangular panels 68 are adhered by a conventional adhesive, as in the manner of panels 38 and 40 of the embodiment of FIG. 1.

The lid shown at FIG. 5 closes the tray by swinging the lid along common fold line 60 so that latch 74 and tongue 18 become interengaged in a releasable manner. It will be understood that the specific latch elements shown are illustrative, with other latch elements also serving. From FIG. 4 it will be observed that generally triangular lid panels 64 are so formed as to define extensions or regions 66 along the direction of common fold axis 60. Fold line 76 defines a lengthwise running elongated ridge at the central portion of the lid, this ridge being the highest region of the lid, and is similar in this respect to point 49 of the first embodiment.

As distinguished from conventional clamshell type containers, the container of this invention exhibits a greater uninterrupted external lid area, in that four lid panels define the lid instead of the conventional five panels (four generally vertical side panels and one flat roof panel). This in turn permits greater uninterrupted areas or zones for lid graphics since the graphics area is not broken or interrupted as much. Further, the slanting lid panels of this invention, as contrasted with the vertical side lid panels of conventional clamshell cartons, provide easier viewing of graphics, each lid panel yielding a slanted easel effect.

As may readily visualized from FIG. 2, lid central tip 49 prevents closed containers from being stacked on top of one another, since static equilibrium is not possible when a flat bottom 12 of an upper closed container is placed on the tip 49 of a lower closed container. The same holds for the embodiment of FIG. 5. Namely, static equilibrium cannot be realized if flat bottom 120 of an upper closed container is placed on ridge 76 of a lower closed container. This stacking preventing feature is important in preventing crushing of a closed container having a food item therein.

I claim:

1. A unitary paperboard blank for forming a gable lid clamshell container, said blank having an upper lid forming portion integrally and foldably connected to a lower, tray forming portion along a common fold line, said tray forming portion including a central bottom panel having a periphery, said central bottom panel including two side walls, a front wall, and a rear wall, said tray walls foldably connected to said bottom panel periphery, said tray front wall having a free edge carrying means for releasably latching said tray to said lid, said lid forming portion including a plurality of generally triangular panels arranged such that an apex of each defines a common point of said lid, one of said lid panels having an edge which is partially collinear with said common fold line and about which said lid is adapted to fold over said tray, two of said lid panels adapted to overlie one another to thereby form a lid having four triangular panels, one of which is a double thickness of said paperboard.

2. The blank of claim 1 wherein said partially collinear lid fold edge is longer than said common lid and tray fold line, whereby said partially collinear fold edge extends beyond both ends of said common lid and tray fold line.

3. The blank of claim 1 wherein a plurality of fold lines and a cut line radiate outwardly from said lid common point, each of said fold lines joining several next adjacent pairs of said triangular lid panels, said cut line separating a next adjacent pair of said triangular lid panels.

4. The blank of claim 3 wherein said lid common point is located generally centrally of said lid.

5. A container formed of a unitary blank of paperboard, said container having a lower tray and an upper lid, said tray having a central bottom panel, side walls, a front wall, and a rear wall, said lid foldably connected to said tray rear wall along a common fold line, said lid including a plurality of triangular panels at least one of which is of a double thickness of said paperboard, one of said lid triangular panels being a rear triangular lid panel and having an edge which is partially collinear with said common fold line, said rear triangular lid panel edge extending beyond both ends of said common fold line.

6. The container of claim 5 wherein said triangular lid panels are arranged such that an apex of each defines a common point on said lid, said common point being above all other portions of said lid, and being above said tray.

7. The container of claim 5 wherein said lid overhangs said tray walls.

* * * * *